United States Patent [19]

Wilson

[11] 4,378,654

[45] Apr. 5, 1983

[54] KIT FOR THE CONSTRUCTION OF A THREE DIMENSIONAL FIGURE

[75] Inventor: Alan A. Wilson, Agincourt, Canada

[73] Assignee: Progressive Merchandising Display Limited, Scarborough, Canada

[21] Appl. No.: 227,960

[22] Filed: Jan. 22, 1981

[30] Foreign Application Priority Data

Jan. 30, 1980 [CA] Canada ..... 344654

[51] Int. Cl.[3] ..... A63H 3/00

[52] U.S. Cl. ..... 46/115; 46/11

[58] Field of Search ..... 46/11, 157, 1 L; 40/538, 539, 540; 428/16, 37; 229/8

[56] References Cited

U.S. PATENT DOCUMENTS

| | | | |
|---|---|---|---|
| 944,153 | 12/1909 | Scott | 46/115 |
| 1,684,244 | 9/1928 | Richardson | 229/8 |
| 1,815,070 | 7/1931 | Prahar | 46/157 X |
| 2,395,247 | 2/1946 | Buffenbarger | 46/157 |
| 2,412,321 | 12/1946 | Chu et al. | 46/157 |
| 3,195,265 | 7/1965 | Marquez et al. | 46/11 |
| 3,354,576 | 11/1967 | Gralnick | 46/11 |
| 3,837,111 | 9/1974 | Godfrey et al. | 46/11 |

*Primary Examiner*—F. Barry Shay

*Attorney, Agent, or Firm*—Ridout & Maybee

[57] ABSTRACT

A kit for the construction of a three dimensional figure having a main portion and an auxiliary portion, comprising in combination a cylindrical core of a roll of a sheet paper product, and a foldable blank delineating the outline of the figure in two dimensions, the outline of the figure having the main portion adapted to be adhered to and wrapped about the vertical axis of the cylindrical core, and the auxiliary portion integral with the main portion and being adapted to be adhered to and bent over the end of the core thereby covering it.

3 Claims, 6 Drawing Figures

KIT FOR THE CONSTRUCTION OF A THREE DIMENSIONAL FIGURE

BACKGROUND OF THE INVENTION

The invention relates to a kit designed to promote the sales of rolls of sheet paper products of the type which are rolled on a relatively stiff cylindrical core, for example, bathroom tissue and kitchen paper towels. More specifically, the kit is intended to provide purchasers of such products with means for construction of three dimensional fanciful figures such as animals. The figures may be made by cutting out a two dimensional blank and adhering the cut-out to the cylindrical core of the sheet paper product so that the assembled components take on a unified appearance.

BRIEF SUMMARY OF THE INVENTION

The present invention provides a kit for the construction of a three dimensional figure having a main portion and an auxiliary portion, comprising in conbination a cylindrical core of a roll of a sheet paper product, and a foldable blank delineating the outline of the figure in two dimensions, the outline of the figure having the main portion adapted to be adhered to and wrapped about the vertical axis of the cylindrical core, and the auxiliary portion integral with the main portion and being adapted to be adhered to and bent over the end of the core thereby covering it. With this arrangement, the end of the core is at least partially concealed so that the tubular core is less identifiable as such in the completed figure.

In the preferred form, the main portion of the outline is provided at the end adjacent the auxiliary portion with spaced apart projections adapted to conform to and abut the auxiliary portion when the three dimensional figure is assembled, with the auxiliary portion extending between the projections and forming therewith an enclosure to conceal said end. In this embodiment, where the figure is, for example, an animal, the end of the core is completely concealed beneath an enclosed portion which forms the animal's head.

BRIEF DESCRIPTION OF THE DRAWINGS

A preferred embodiment of the invention is shown in the accompanying drawings in which.

DESCRIPTION OF THE PREFERRED EMBODIMENT

Figure 1B:
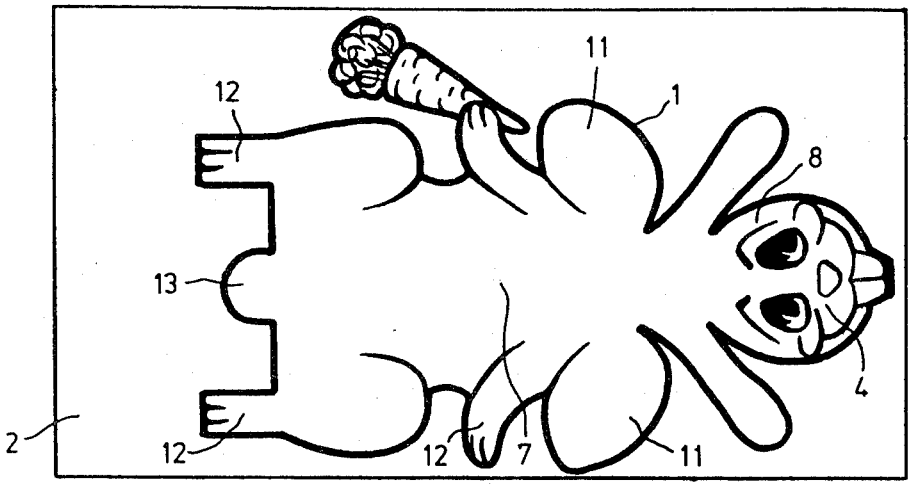
FIGS. 1*a* and 1*b* depict opposite sides of a sheet paper blank delineating an animal figure.

A two dimensional outline 1 is printed on both sides of a suitable sheet paper blank 2 principally to aid in cutting the outline 1 from the blank 2. Dotted lines 3 are provided where a fold is indicated, and details 4 are included within the outline 1 as desired. The two dimensional outline 1 is preferably printed on the sheet of paper 2 in black and white so that a child assembling the figure can provide the colouring.

Figure 1A:
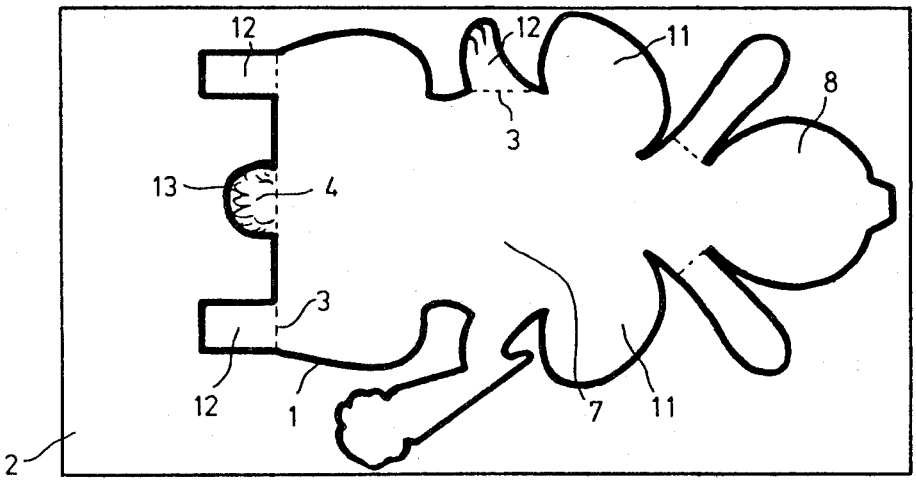
Figure 4:
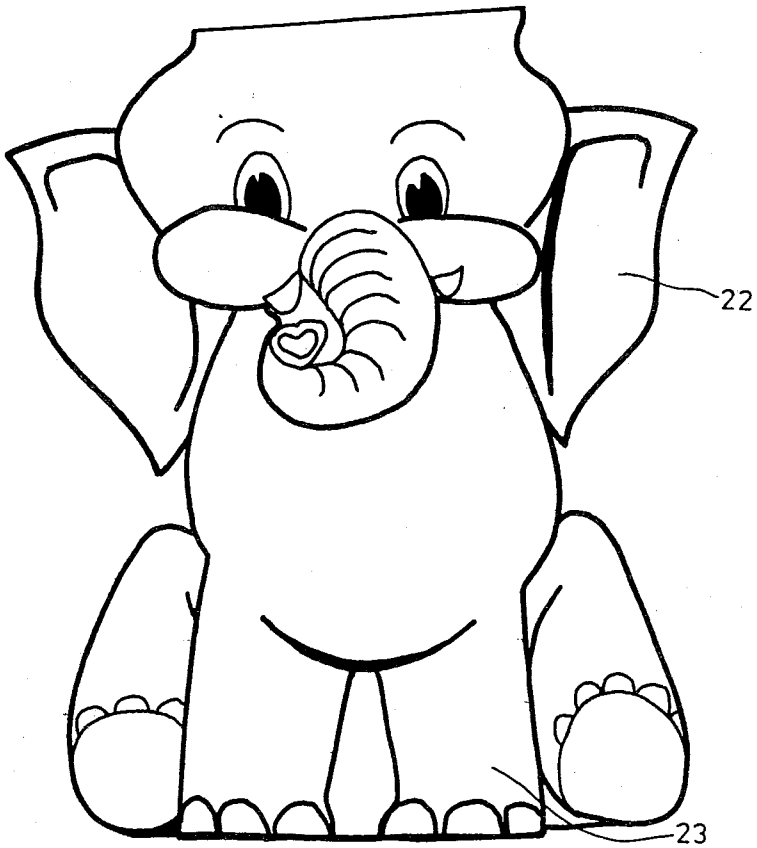
FIG. 4 shows a perspective view of the cut-out and the secondary piece of FIGS. 3*a* and 3*b* assembled with a cylindrical core.
Figure 2:
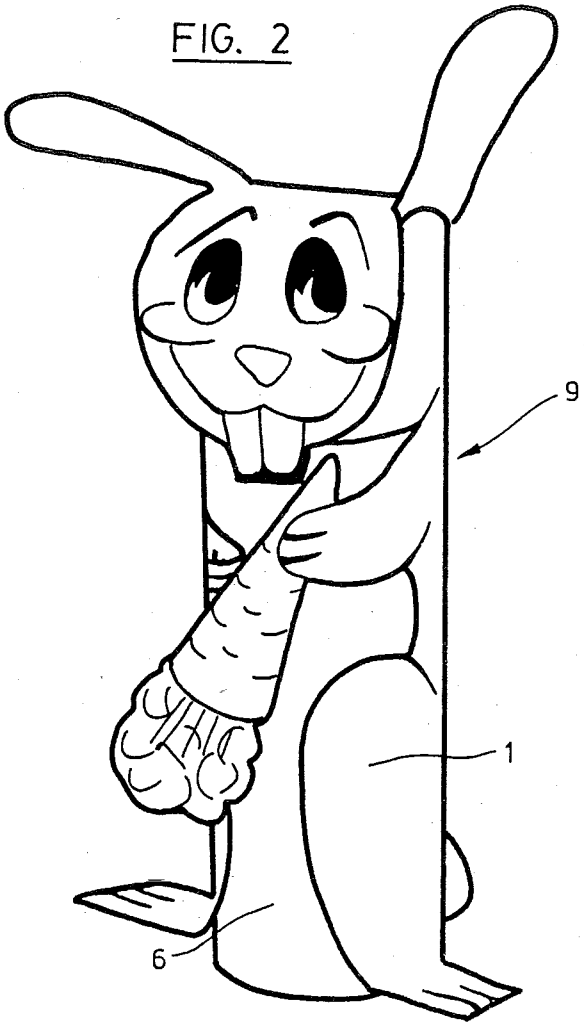
FIG. 2 shows a perspective view of the cut-out of FIGS. 1*a* and 1*b* assembled with a cylindrical core; further

In the preferred embodiment, outline 1 is designed to fit around cardboard tube 6, as shown in FIG. 2. When the outline 1 has been coloured and cut from blank 2 and the indicated folds are made, a main portion 7 of outline 1 is wrapped about the vertical axis of tube 6 and adhered thereto. An integral auxiliary portion 8 of outline 1 is then bent over the upper end of tube 6 and adhered thereto completing the construction of the basic three dimensional FIG. 9. Projections 11 are spaced apart on main portion 7 adjacent to auxiliary portion 8. Construction of the three dimensional FIG. 9 results in the edges of the bent over auxiliary portion 8 conforming to and abutting the curved upper edges of the projections 11 thereby enclosing the end of core 6 and concealing it. In the case of the fanciful rabbit figure illustrated in FIGS. 1 and 2, projections 11 and portion 8 combine to form the sides and front of the rabbit's head, respectively. The result is a figure possessing a high degree of three dimensional character and aesthetic appeal. The realism of the rabbit of FIGS. 1*a, b* and 2 is further enhanced by including paw and tail portions 12 and 13, demarcated by folding lines 3, which are adapted to project outwardly from the surface of the core in the completed animal figure.

The basic figure resulting from the assembly of outline 1 and tubular core 6, may result in a figure having a portion of the surface of the tubular core 6 exposed between the edges of the body portion 7. Coverage of this exposed surface area by employing secondary pieces, produces an even more realistic figure having the tubular core 6 more completely disguised.

Figure 3B:
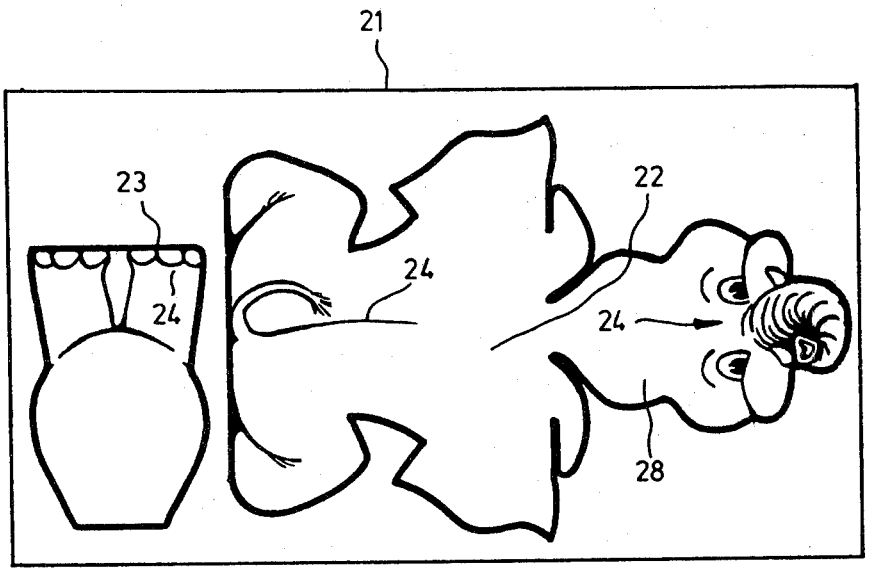
FIGS. 3*a* and 3*b* depict opposite sides of a sheet paper blank delineating an animal figure and a secondary piece.
Figure 3A:
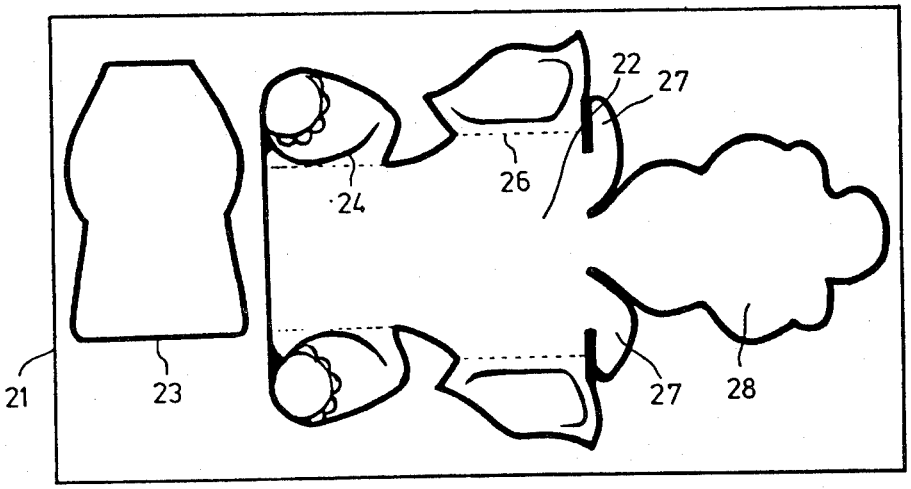

In this regard FIGS. 3*a* and 3*b* shows sheet 21 delineating an elephant outline 22 and a secondary piece 23. The appropriate details 24 and the indicated fold lines 26 are provided on outline 22 and secondary piece 23 as needed. Outline 22 is assembled onto a tubular core in the same manner as previously described, and secondary piece 23 is then adhered to the front portion of the core thereby covering the remaining exposed surface of the core and adding further detail to the figure to enhance its realism. It may be noted that in the elephant outline of FIGS. 3*a* and *b*, there are projections 27 that form with the auxiliary portion 28 a representation of the sides and front of the animal's head.

Variations of the embodiments as described will be apparent to the reader without departing from the scope of the invention consisting of the description herein and as set forth in the appended claims.

I claim:

1. A kit for the construction of a three dimensional figure having a body portion and a head portion integral therewith, comprising:

a cylindrical core of a roll of sheet paper product;

a wrappable member having a peripheral contour delineating the outline of the figure in two dimensions, the body portion having projecting limbs and being wrappable about the vertical axis of the cylindrical core including portions adapted to project outwardly from the surface of the core, and the head portion being wrappable over the end of the core thereby covering it; and spaced apart projections on the member positioned at the end of the body portion adjacent the head portion, the projections being shaped to conform to and abut the head portion when the three dimensional figure is assembled, with the head portion extending between the projections and forming therewith an enclosure to conceal the core end.

2. A kit as claimed in claim 1, wherein the outline of the figure partially covers the surface of the core when adhered thereto, and including at least one secondary piece adapted to be adhered to the core thereby covering an exposed portion of the core.

3. A kit as claimed in claim 1 or 2, wherein the wrappable member is of paper.

* * * * *